US006004376A

United States Patent [19]

Frank

[11] Patent Number: 6,004,376

[45] Date of Patent: Dec. 21, 1999

[54] METHOD FOR THE ELECTRICAL CHARGING AND SEPARATION OF PARTICLES THAT ARE DIFFICULT TO SEPARATE FROM A GAS FLOW

[75] Inventor: Werner J. Frank, Bergisch Gladbach, Germany

[73] Assignee: Apparatebau Rothemühle Brandt & Kritzler GmbH, Wenden-Rothemuhle, Germany

[21] Appl. No.: 08/984,876

[22] Filed: Dec. 4, 1997

[30] Foreign Application Priority Data

Dec. 6, 1996 [DE] Germany ..... 196 50 585

[51] Int. Cl.[6] ..... B03C 3/08

[52] U.S. Cl. ..... 95/79; 96/77

[58] Field of Search ..... 95/79, 80; 96/77, 96/78, 79

[56] References Cited

U.S. PATENT DOCUMENTS 1,343,285 6/1920 Schmidt ..... 95/79

3,518,462 6/1970 Brown ..... 96/77 X 3,907,520 9/1975 Huang et al. ..... 95/79 X 4,203,948 5/1980 Brundbjerg ..... 96/77 X 4,225,323 9/1980 Zarchy et al. ..... 96/77 X 5,055,118 10/1991 Nagoshi et al. ..... 96/77 X 5,290,343 3/1994 Morita et al. ..... 96/77 X

*Primary Examiner*—Richard L. Chiesa

*Attorney, Agent, or Firm*—Friedrich Kueffner

[57] ABSTRACT

A method for removing electrostatically charged particles that are difficult to separate from a gas flow within one or more high-voltage fields, wherein only one high-voltage supply source is used for these high-voltage fields. The flows to be cleaned are successively ionized in an ionizing region and the particles are separated in a separating region within the one or more high-voltage fields, wherein the field strength of the ionizing region is weaker than the field strength of the separating region.

4 Claims, 3 Drawing Sheets

1
19
16
GAS EXIT
2
5
17
11
7
4
18
6
15
GAS ENTRY
12

METHOD FOR THE ELECTRICAL CHARGING AND SEPARATION OF PARTICLES THAT ARE DIFFICULT TO SEPARATE FROM A GAS FLOW

BACKGROUND OF THE INVENTION

1. Field of the Invention

The present invention relates to a method of removing electrostatically charged particles that are difficult to separate from a gas flow within one or more high-voltage fields, wherein only one high-voltage supply source is used for these high-voltage fields. This is particularly applicable to such particles which by virtue of their physical/chemical properties partly or completely elude the otherwise highly efficient separation in a conventional electrostatic filter or precipitator operating according to the Cottrell principle.

2. Description of the Related Art

As is known, in an electrostatic filter operating in accordance with the so-called Cottrell principle, the charging and transporting of the particles to be separated as well as their deposition on specially shaped precipitation electrodes is carried out in an electrical field, wherein, after an adequate accumulation or agglomeration, the particles are removed from the precipitation electrodes either by mechanical shaking (dry cleaning) or by flushing (wet cleaning). If necessary, several electric fields of the type described above are connected in series with or parallel to each other to achieve the desired overall separating capacity.

The problem of particles that are difficult to separate can be attributed both to the chemical/physical properties of the particles which lead to an insulating layer on the precipitation electrodes and/or to the fact that, due to the electrical flow turbulence or the so-called electrical wind associated with a high current density, as a result of gas ionization in the region between the charging and separating electrodes it is more difficult to deposit on the precipitation electrodes that proportion of the particles which have a grain size of $<10\ \mu m$. At the same time, it is known that as a consequence of the charging mechanism, namely the so-called impact or field and diffusion charging, a pronounced minimum particle fraction separation output occurs. To counteract the problem of an electrical flow turbulence caused by electrical wind, so-called 2-stage electrostatic filters have been developed, wherein the charging and the separation of the particles is carried out in consecutively connected separate electrical fields. The disadvantage of this method include the required spatial separation of the stages and the supply of different electrical high-voltages.

SUMMARY OF THE INVENTION

The primary object of the present invention is to avoid the disadvantages of the above described electrostatic precipitation method and to develop a method wherein an efficient charging of the particles is carried out in each electrical field with the aid of only one high-voltage source, so that the transport of the charged particles and their separation on the opposite polarized separating electrodes is carried out with an adequately strong field.

In accordance with the present invention, the flows to be cleaned are successively ionized and separated within the high-voltage field, wherein the field strength of the ionizing region is weaker than the field strength of the of the separating region.

This means that one region of extreme ionization with correspondingly high electrical turbulence and/or electrical wind transversely to the gas flow is followed by an extremely calm practically laminar region, essentially without electrical turbulence, in which the separation of the charged particles that are difficult to separate can be carried out highly efficiently and unhindered.

The efficient charging of the particles is carried out by using a high voltage which generates in the subsequent separating region a field strength sufficient for the transport and the separation of the particles.

In principle, this will be realized for various electrostatic filter constructions. On the one hand, in the case of a high-voltage source, geometrically greater sputter distances are set in the ionizing region than in the separating region relative to the precipitation electrodes connected to the ground. On the other hand, the geometries of the normally negative sputter electrodes have different constructions for the ionizing and separating regions. Thus, for the ionizing region, a highly current-intensive sputter electrode design is chosen, whereas for the separating region an extremely current-deficient or voltage-intensive sputter electrode is used.

If necessary, several sections can be provided in principle for ionization and separation within an electrostatic filter if the single-stage particle charging is insufficient.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

The electrical separation process according to the invention can be used in electrostatic filters or precipitators of all types and constructions.

To achieve an electric field strength in the region of separation which is as high as possible in a horizontally-oriented electrostatic filter, the use of more than one adjacent filter passages is proposed for the ionizing region. By virtue of this arrangement, the requirements of ionization and separation can be matched to suit each other, resulting in the use of only one high-voltage supply unit per filter field.

Figure 1:
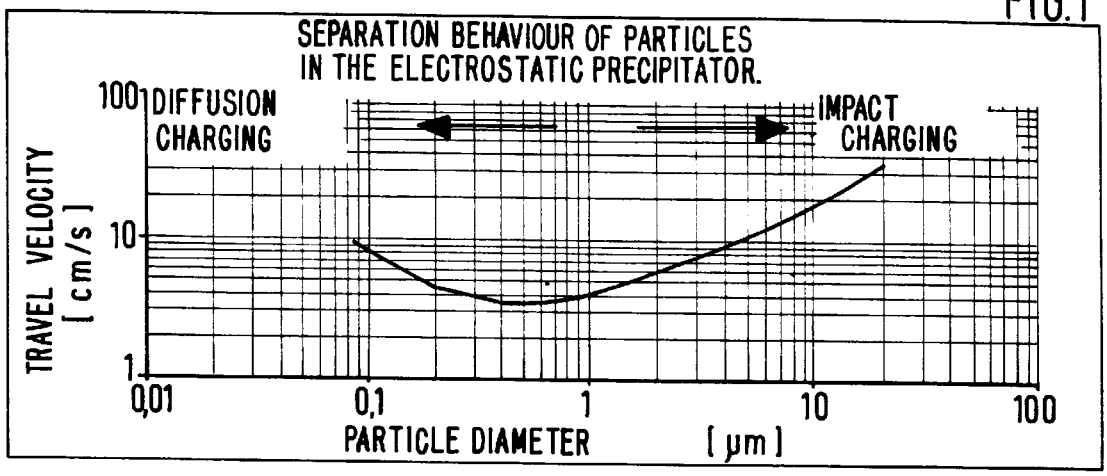
FIG. 1 is a diagram showing the particle separation behavior in an electrostatic filter.

FIG. 1 shows the overall view of the separation behavior of the particles in an electrostatic filter. As a result of the charging mechanism, namely the so-called impact or field charging and the diffusion charging, a pronounced minimum particle fraction separation output occurs. This can be seen from the illustrated curve.

Figure 2:
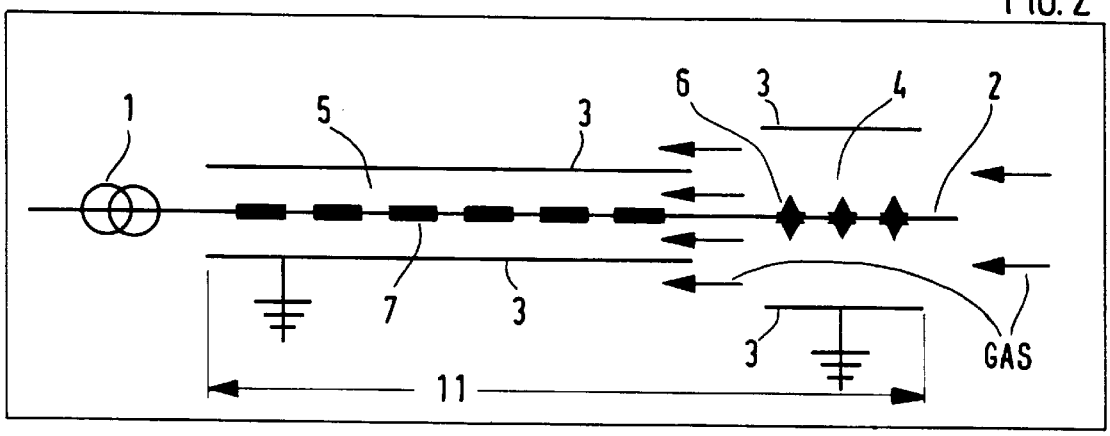
FIG. 2 is a schematic view showing an overall arrangement of an embodiment of the invention.

FIG. 2 shows the overall view of a single separating passage with a preceding enlarged ionizing passage. The adjacent passages are not shown. Connected to a high-voltage current source 1 is a high-voltage system 2 which is provided with current-intensive sputter electrodes 6 and voltage-intensive or current-deficient sputter electrodes 7. The sputter electrodes 6 are situated in an ionizing region 4, which is formed by the precipitation electrodes 3. The sputter electrodes 7 are situated in a separating region 5, which is formed by the grounded precipitation electrodes 3. The entire high-voltage field is designated by 11. The geometrical construction of the ionizing region 4 and of the separating region 5 is such that the sputter distances in the ionizing region are greater than the sputter distances in the separating region. In the enlarged ionizing region 4, an adequate charging of the particles is achieved, the particles being then separated in the following separating region 5 having reduced the turbulence and almost eliminated electrical wind.

Figure 3:
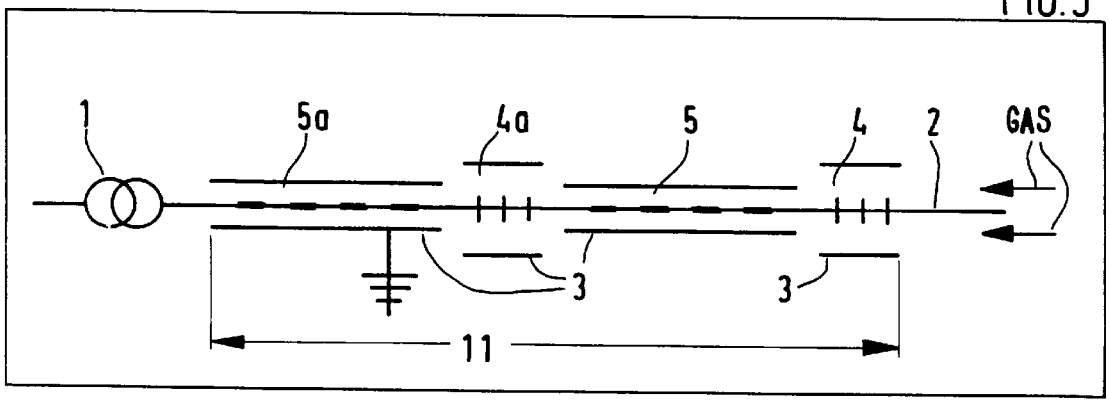
FIG. 3 is a schematic view showing a further overall arrangement.

If the single-stage charging of the particles is insufficient, a further ionizing region 4*a* with a separating region 5*a* according to FIG. 3 can be connected downstream from the ionizing region 4 and the separating region 5.

Figure 4:
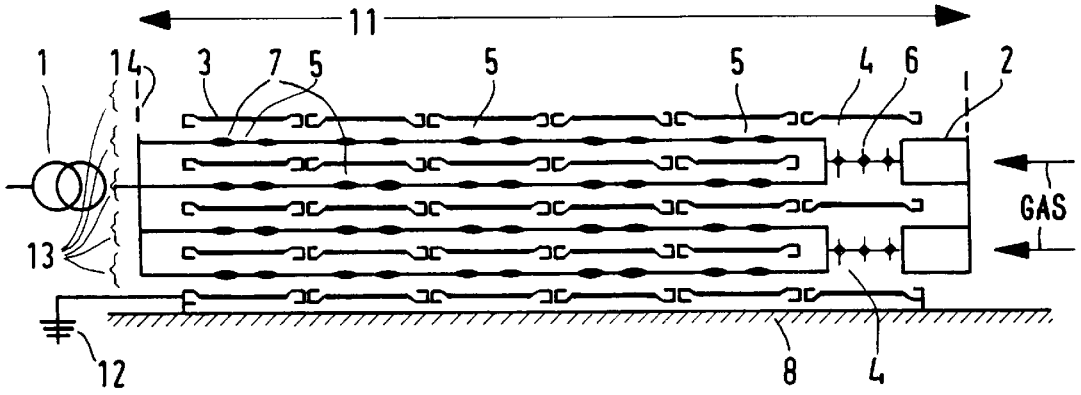
FIG. 4 is a schematic view showing a horizontal field with an ionizing region.

FIG. 4 is a schematic illustration of a horizontally arranged electrostatic filter. Several rows of precipitation electrodes 3 inside of a filter housing 8 with the grounding 12 form several separating passages 13 in the separating region 5. In each of these separating passages voltage-intensive sputter electrodes 7 are provided. Viewed in the direction of flow, each ionizing region 4 with the current-intensive sputter electrode 6 and with the sputter electrodes 7 has two downstream connected separating passages 13. The dotted lines 14 indicate that further passages 13 may be connected.

Figure 5:
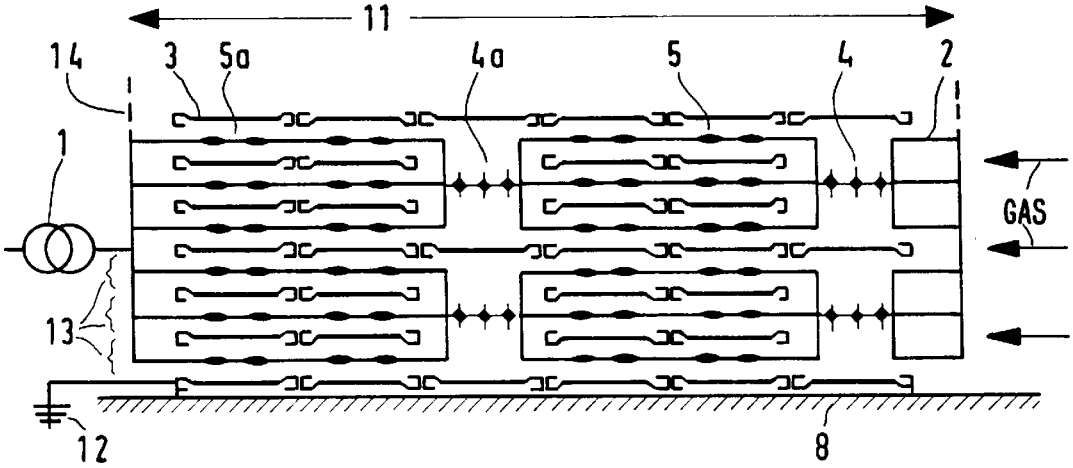
FIG. 5 is a schematic view showing a horizontal field with two ionizing regions.

FIG. 5 shows a further embodiment according to which three passages 13 are connected downstream from an ionizing region 4. In this case, the gas is charged in an ionizing region and separated in three passages within the separating region 5. In addition, this embodiment shows that a further ionizing region 4*a* with a separating region 5*a* is connected downstream from the ionizing region 4.

Figure 6:
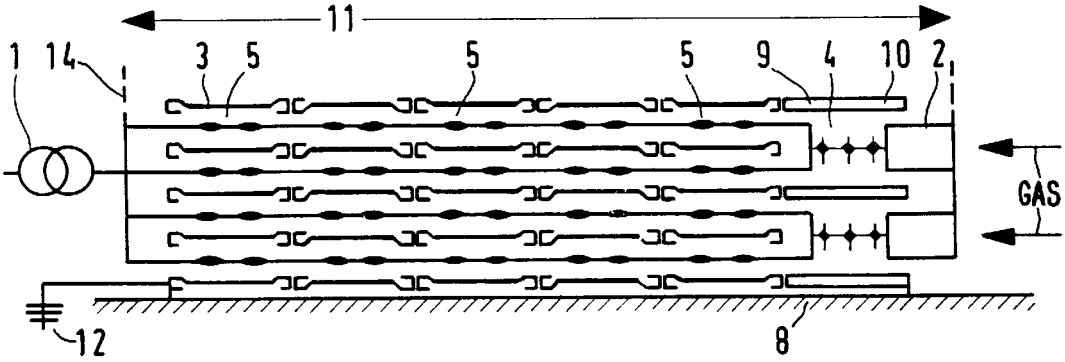
FIG. 6 is a schematic view showing a horizontal field with cooled precipitation electrodes in the ionizing region.

FIG. 6 shows an embodiment with an ionizing region 4, wherein the grounded precipitation electrodes 9 are illustrated as hollow bodies, through which flows a cooling medium 10. Reionization due to electrical particle resistance is prevented by this cooling.

Figure 7:
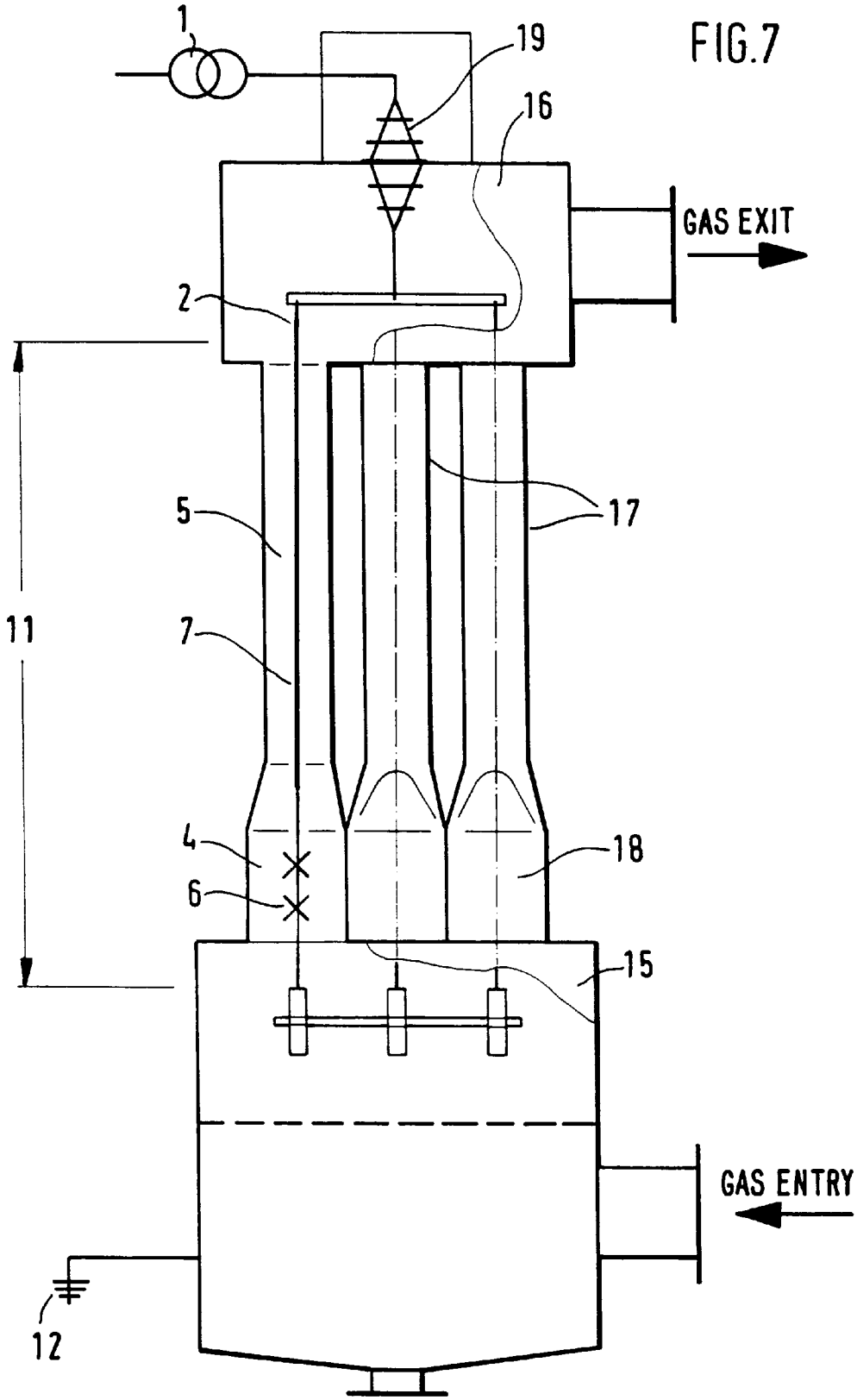
FIG. 7 is a schematic view showing a horizontal field with a single-field vertical filter.

FIG. 7 shows the embodiment of a vertical single-field tube filter. Several tubes 17 having an enlarged cross-section 18 in the entry region are provided between an entry housing 15 and an exit housing 16. The high-voltage system 2 is connected to the high-voltage current supply 1 via an insulator 19. The enlarged tubular cross-section 18 with the current-intensive sputter electrodes 6 forms the ionizing region 4 and the tubes 17 with the voltage-intensive sputter electrodes 7 form the separating region 5. The tubes 17 with the enlarged cross-section 18 simultaneously form the grounded precipitation electrodes.

The essence of the invention is clearly demonstrated in the embodiments, namely the achievement of charging within a high-voltage field 11 with only one high-voltage source 1 in an enlarged ionizing region 4 and then separation of the particles from the fluid to be cleaned in the following smaller single passages.

While specific embodiments of the invention have been shown and described in detail to illustrate the inventive principles, it will be understood that the invention may be embodied otherwise without departing from such principles.

I claim:

1. A method of electrically charging and separating particles which are difficult to separate from a gas fluid within at least one high-voltage field, wherein a single high-voltage source is used for the at least one high-voltage field, the high-voltage field having an ionizing region comprised of current-intensive sputter electrodes and a separating region comprised of current-deficient and voltage-intensive sputter electrodes, the method comprising successively ionizing the gas fluid in the ionizing region of the high-voltage field and then separating the particles from the gas fluid in the separating region of the high-voltage field, and adjusting a field strength of the ionizing region so as to be weaker than a field strength of the separating region.

2. The method according to claim 1, comprising ionizing and separating the gas fluid within the high-voltage field on two or more successive occasions.

3. The method according to claim 1, comprising ionizing the gas fluid in a passage of the ionizing region and subsequently separating the particles from the gas fluid in two or more passages of the separating region having smaller widths than the passage of the ionizing region.

4. The method according to claim 1, wherein the ionizing region has grounded electrodes, further comprising cooling the electrodes of the ionizing region.

* * * * *